United States Patent [19]

Hayes

[11] 4,189,296

[45] Feb. 19, 1980

[54] METHOD AND APPARATUS FOR CONTROLLING FURNACE

[75] Inventor: Thomas E. Hayes, Goshen, Ind.

[73] Assignee: Johnson Controls, Inc., Milwaukee, Wis.

[21] Appl. No.: 885,867

[22] Filed: Mar. 13, 1978

[51] Int. Cl.[2] ..... F23N 1/00; F23N 5/20

[52] U.S. Cl. ..... 431/20; 431/6; 236/1 G

[58] Field of Search ..... 431/20, 2, 6; 236/1 G, 236/45

[56] References Cited

U.S. PATENT DOCUMENTS

| | | | |
|---|---|---|---|
| 2,154,644 | 4/1939 | Sweatt | 431/20 |
| 2,155,642 | 4/1939 | Dewey | 431/20 X |
| 2,188,865 | 1/1940 | Maynard | 431/20 |
| 2,377,356 | 6/1945 | Miller | 236/1 G |
| 3,311,302 | 3/1967 | Merckle | 236/45 |
| 3,449,055 | 6/1969 | Blackett | 431/26 |
| 3,768,956 | 10/1973 | Mueller et al. | 431/20 |
| 3,934,796 | 1/1976 | Smith, Jr. et al. | 431/20 |

*Primary Examiner*—Carroll B. Dority, Jr.
*Assistant Examiner*—Lee E. Barrett
*Attorney, Agent, or Firm*—Emrich, Root, O'Keeffe & Lee

[57] ABSTRACT

A control system for use with gas-fired appliance installations, such as a furnace, includes a switch responsive to normal draft levels in the vent stack. At the start of a heating cycle, and in the absence of draft, the switch permits a pre-draft enabling circuit to tentatively enable the furnace controller for a predetermined time. The controller opens a stack damper plate and actuates the ignition system and gas valves of the furnace. If draft is not established within the predetermined time, the pre-draft enabling circuit times out and the gas is shut off. If normal draft is sensed within the predetermined time, the draft responsive switch permits the furnace controller to be operated as long as the thermostat calls for heat. If, for any reason, draft subsequently stops, the control system re-cycles itself; and if draft is not re-established before the pre-draft enabling circuit times out, the system deactivates the furnace controller. The control system also includes a normally closed barometric damper, which is mounted in the vent stack and is responsive to both excessive positive pressure and to excessive draft (sub-ambient pressure) to open, and thereby neutralize the excessive positive pressure or draft.

21 Claims, 1 Drawing Figure

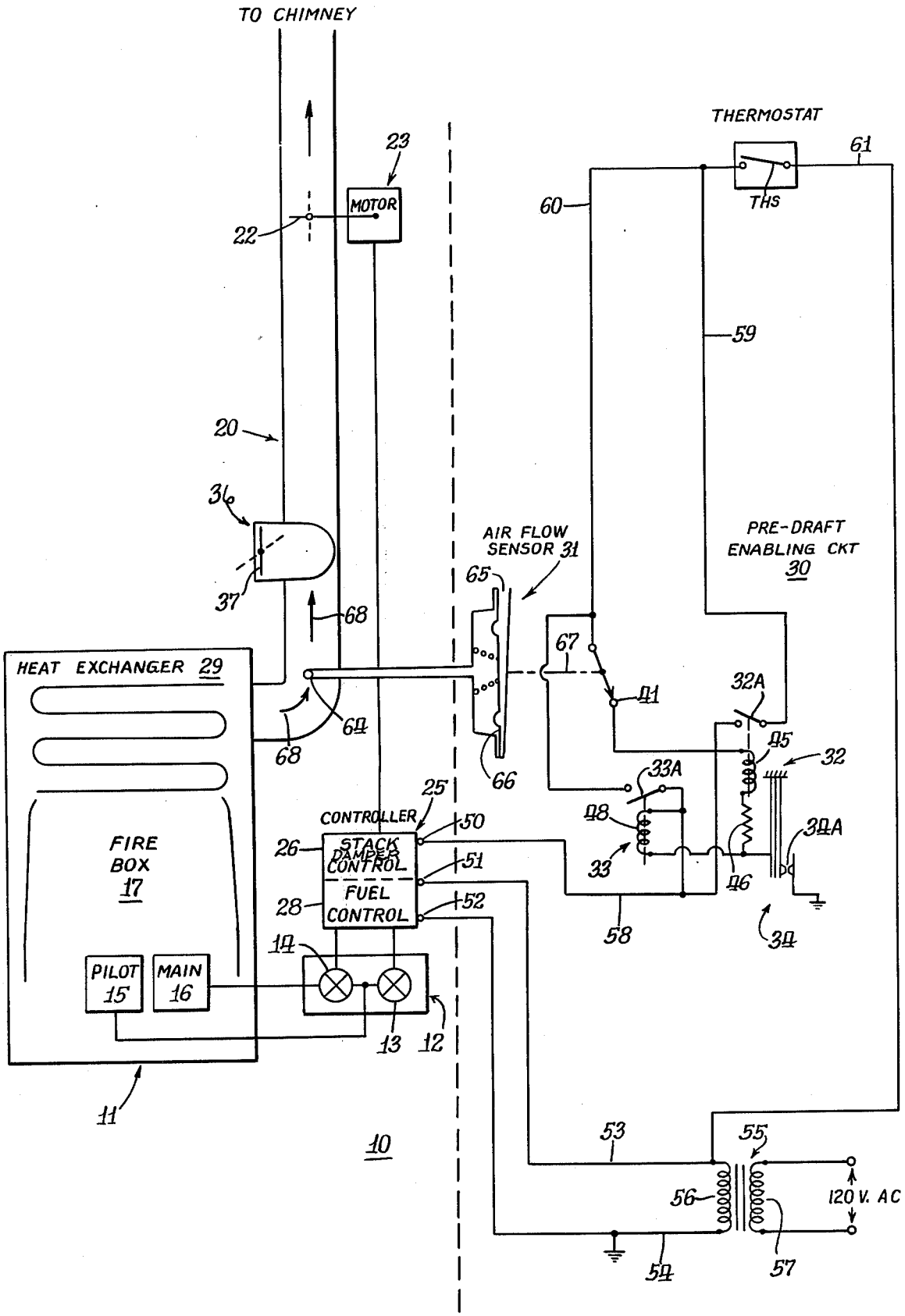
TO CHIMNEY
THERMOSTAT
THS
MOTOR
AIR FLOW SENSOR 31
PRE-DRAFT ENABLING CKT 30
HEAT EXCHANGER 29
FIRE BOX 17
PILOT 15
MAIN 16
CONTROLLER
STACK DAMPER CONTROL
FUEL CONTROL
120 V. AC

METHOD AND APPARATUS FOR CONTROLLING FURNACE

BACKGROUND OF THE INVENTION

1. Field of the Invention

This invention relates to gas-fired appliance installations, and more particularly to a control system for such installations which eliminates the need for a conventional draft hood, while satisfying the purposes of the draft hood.

2. Description of the Prior Art

For many years, a draft hood has been a part of gas-fired appliances such as furnaces, water heaters, and the like. The draft hood is a fitting or device which is placed in and made a part of the flue pipe or vent stack, which vents the products of combustion from the firebox of the appliance to a chimney. One purpose of the draft hood is to provide for the ready escape of the combustion products in the event of no draft, back draft, or stoppage beyond the draft hood. The draft hood also neutralizes the effect of stack action of the chimney upon the operation of the appliance, and prevents back drafts from entering the appliance.

Draft hoods, which came into general use in an era of low cost energy, are very wasteful of energy. For example, in a furnace installation, the draft hood provides a massive leak to the external environment, typically a basement room in which the furnace is located. The draft hood permits air at room temperature to freely enter the flue through the draft hood opening which is typically over four times the cross-sectional area of the flue pipe. The draft hood also allows a back draft to simply blow out into the room, and should the flue become blocked, the products of combustion may also be exhausted into the room. Excessive stack draft is "short circuited" by the massive leak so that it is not seen by the firebox.

A further consideration is that when a gas furnace is not firing, a great deal of warmed room air is swept into the draft hood and up the chimney by the stack effect of the chimney itself. Warming this volume of "lost" room air requires fuel expenditure. Systems have been proposed to lessen stack losses by using a motor driven stack damper to close the vent stack when the furnace is off and to open the vent stack just before the furnace is turned on. However, when the furnace is on, this stack loss is even greater due to the increased stack effect of hot flue gasses. Accordingly, it would be desirable to have a furnace control system which satisfies the purposes of a conventional draft hood and eliminates the need for such draft hood.

A secondary energy loss in conventional draft hoods occurs due to the dilution of the flue gas and the resultant cooling of the stack gasses. It has been long established that the temperature of stack gasses issuing from the top of a chimney must be kept above approximately 250° F. in order to avoid condensation of moisture laden with acids. When the flue gas from a furnace passes through the portion of vent in which a draft hood is provided, the hot air is diluted with cooler room air so that the temperature is reduced by over 200° F. This is reported, for example, in Underwriters Laboratories Bulletin of Research No. 51, pages 62–63. If the draft hood is eliminated, as with the present invention, the system will have additional heat capacity. That is, a considerable amount of extra heat can be recovered and supplied to the heated space resulting in improved operating efficiency for the furnace. Stated in another way, the use of a draft hood requires that the furnace heat exchanger extract 200° less from the flue gasses than would be allowable without the draft hood. Thus, a system which eliminates the need for a conventional draft hood would both minimize the loss of warmed room air and would permit use of increased heat exchanger capacity to the system.

SUMMARY OF THE INVENTION

The present invention provides a control system for use with gas-fired appliance installations, such as a furnace, which eliminates the need for a conventional draft hood. The control system provides safe operation of the appliance by shutting down of the appliance if, for any reason, proper draft is not maintained.

When used alone, the term "draft" means the amount of pressure below surrounding ambient atmosphere which exists in a furnace, breaching, vent or stack. The terms "down draft" or "back draft" may however, refer to a reversal of flow in the chimney, according to the context. A draft within normal limits is to be expected during operation of a furnace. The range of normal draft depends, of course, on the size and design of a furnace. Excessive draft (sub-atmospheric pressure) may cause inefficient operation of the burner, and is undesirable just as excessive positive pressure in the stack is undesirable.

The control system includes a switch responsive to draft in the vent stack. Upon an initial call for heat by the closing of thermostat contacts, a pre-draft enabling circuit is energized to enable furnace controller for a predetermined time, allowing the furnace controller to open a stack damper plate and to actuate the gas valves of the furnace. If draft is not established within the predetermined time, the pre-draft enabling circuit times out and the gas is shut off. If normal draft is sensed within the predetermined time, the draft responsive switch permits the furnace controller to continue to operate as long as the thermostat calls for heat.

If normal draft subsequently ceases, the control system initiates a new pre-draft timing cycle, and if normal draft is not reestablished before the pre-draft enabling circuit times out, the system de-activates the furnace controller to shut off the gas valves. In other words, if draft is lost through a blockage or other circumstance that might cause the pressure to rise to atmospheric, a pre-draft timing period is started, or if a strong down draft of air in the stack causes the pressure to rise above atmospheric, the same cycle is initiated. Thus, undesirable conditions such as these are not permitted to persist beyond the pre-draft enable period.

The control system also includes a barometric damper, which is mounted in the vent stack and is normally closed. If excessive stack draft (i.e. negative pressure below the normal draft range for the system) or excessive positive pressure above atmospheric) is sensed, the damper opens to communicate the stack with the ambient and thereby neutralize the undesired circumstance.

The control system of the present invention satisfies or circumvents the functions of the draft hood heretofore used in gas-fired appliance installations. The elimination of draft hood as with the present invention both eliminates the loss of warmed room air and allows a considerable amount of extra heat to be recovered from the flue gasses and supplied to the heated space, resulting in increased heating efficiency and lower fuel costs. Further, the preferred embodiment provides a fail-safe operation in the sense that safe operation of the system is obtained even though failure might occur in one or more elements of the system. Other features and advantages will be apparent to persons skilled in the art from the following detailed description accompanied by the attached drawing.

DESCRIPTION OF THE DRAWING

The drawing is a diagrammatic representation of a furnace installation which includes a control system incorporating the present invention.

DETAILED DESCRIPTION

Referring to the drawing, the control system provided by the present invention may be used with gas-fired appliances, such as furnaces, water heaters, or the like, wherein combustion products are vented from the appliance by way of a vent stack. For the purpose of illustration, the control system is described with reference to an application in a heating installation 10 including a gas-fired furnace 11. The furnace is operated to supply heat to a space in response to the closing of contacts THS of a thermostat which is located within the space being heated. The furnace has an associated controller generally designated 25 which includes a fuel supply control circuit 28 for controlling fuel valves 12 which supply fuel to burner apparatus of the furnace. The fuel supply valves 12 include a pilot valve 13 which supplies gas to a pilot outlet 15, and a main valve 14 which supplies gas to a main burner 16. Combustion products are exhausted from the fire box 17 of the furnace 11 by way of a vent stack 20 which leads to a chimney.

For the purpose of preventing the escape of warmed air up the chimney while the furnace is shut down, a stack damper plate 22 is mounted within the vent stack 20 to close the vent stack whenever the furnace is shut down. The damper plate 22 is operative to open the vent stack prior to operation of the furnace to permit exhaust products to be vented to the chimney. The damper plate 22 is driven between the closed position, represented in solid line, and the open position, represented in dashed line, by a drive motor 23 operated under the control of a stack damper control circuit 26 of the furnace controller 25.

The control system includes a pre-draft enabling circuit generally designated 30, including a relay 32 and a warp switch timing device 34, which defines a pre-draft timing cycle or interval and controls the operation of the furnace controller 25. The pre-draft enabling circuit 30 via relay 32 enables the furnace controller 25 to activate the furnace tentatively at the start of each heating cycle for a time interval defined by the warp switch timer. A draft switch 31 senses draft in the stack and controls de-activates the pre-draft timer before it times out to allow the furnace to continue to operated only if sufficient draft is established in the vent stack within the time interval. A holding relay 32 remains operated when draft is sensed by the switch 31; and the warp switch timer 34 is de-energized—ready for another pre-draft timing interval if draft is lost for any reason. If draft fails to be established within the pre-draft time interval defined by the warp switch timer 34, it operates to shut down to furnace and lock out the system. The draft switch responds to loss of draft (i.e. a pressure at atmospheric or above) during the heating cycle to cause the enabling circuit to initiate a new time cycle and shut down the furnace if draft fails to be re-established within the newly initiated time interval.

The control system also includes a barometric damper 36 mounted in the vent stack 20. The damper 36 responds both to excessive draft below the normal draft range for the particular system and to positive pressure above the normal draft range to open its damper plate 37 to communicate the stack with the ambient atmosphere and thereby neutralize stack pressure. As long as draft is within the normal range, the barometric damper remains closed. It will also be observed that the barometric damper is located on the upstream side of the stack damper 22 so that it is isolated from chimney effects when the system is not being operated.

Considering the heating installation 10 in more detail, the furnace controller is similar to the one shown in co-owned U.S. pat. application Ser. No. 826,952, which was filed Sept. 27, 1976. The composition and operation of such controller is fully described in the referenced patent application and will not be described in detail herein.

Briefly, the controller 25 has an enabling input 50 and power inputs 51 and 52 which are connected to a secondary winding 56 of an input transformer 55, a primary winding 57 of which is connected to a source of AC power.

The stack damper control circuit 26 corresponds to circuitry (not shown) of the referenced controller, including limit switches, which permits a drive motor 23 to be energized when a signal is applied to input 50 (conductor L1 of the referenced controller). When energized, the motor drives the stack damper plate from its normally closed position to the open position. The stack damper control circuit deenergizes the motor when the damper plate reaches the fully open position.

The fuel supply control circuit 28 corresponds to circuitry (not shown) of the referenced controller including control relays, an igniter, and a flame sensing circuit. The circuitry permits the pilot valve and igniter to be energized only when the damper plate is fully open and permits the main valve to be energized only when a pilot flame is established. When the heating demand has been met, the fuel supply control circuit 28 deenergizes the fuel valves to interrupt the supply of gas to the furnace, and the stack damper control circuit reenergizes the motor to drive the damper plate back to the closed position.

With reference to the control system, the draft switch 31 may be a differential pressure sensing switch, such as the Type P-32 Differential Pressure Switch which is commercially available from the Penn Division of Johnson Controls Inc., Goshen, Indiana. The draft switch is installed on a vertically extending portion of the vent stack 20 between the outlet of the fire box 17 and the damper plate 22 with its low pressure inlet 64 disposed within the vent stack and its high pressure inlet 65 communicating with ambient atmosphere. The high and low pressure inlets communicate with opposite sides of a spring-loaded diaphragm 66 which operates normally-closed contacts 41 via an actuator link 67.

In the absence of draft within the normal range, the switch is operated to the position shown by spring load with contacts 41 closed. When the switch 31 senses negative gauge pressure of at least 0.03" $H_2O$, provided as the result of introducing heated gasses (combustion products) into the vent stack in the direction of the arrows 68, the actuator 67 is moved to the left and the contacts 41 open. For a loss of draft (or positive pressure caused, for example, by a chimney down draft) during a heating cycle, the increase in differential pressure causes the actuator 67 to be moved to the right and the contacts 41 close to initiate another timing cycle.

Referring to the pre-draft enabling circuit 30, a coil 45 of relay 32 and the heater element 46 of the warp switch are connected in a series energizing path which extends from one side of the contacts THS over conductor 60, the normally closed contacts 41 of the draft switch 31, the winding 45 and the heater element 46 to ground over the normally closed contacts 34A of the warp switch. This permits the coil 45 and the heater element 46 to be energized whenever contacts THS close to energize conductor 60, and the draft switch 31 is unoperated—i.e. in the absence of draft. When coil 45 is energized, the relay 32 operates to close its contacts 32A and thereby energize conductor 58 which is connected to the controller input 50, thus enabling the controller.

The coil 48 of relay 33 has one side connected to conductor 58 and its other side connected to the junction between the heater element 46 and contacts 34A. This relay is energized when conductor 58 is energized and the warp switch has not actuated. When relay 33 is operated, its contacts 33A close to connect conductor 60 to conductor 58 to provide a holding path for the relay and to maintain the furnace controller 25 enabled even though relay 32 will have been deenergized by the draft switch, during a normal start cycle and before the end of the pre-draft interval.

As mentioned, when the warp switch heater 46 is energized, the timing device 34 defines the pre-draft timing interval, typically in the order of one to three minutes. Under normal operating conditions, a draft is provided through the vent stack 20 before the end of this timing interval, and the draft switch operates to disable the pre-draft enabling circuit by interrupting the energizing path for relay coil 45 and the warp switch heater 46, and allowing the furnace controller to be maintained enabled for the balance of the heating cycle over a path provided by contacts 33A of relay 33. If draft switch 31 does not operate before the warp switch times out, contacts 34A open (preferrably under spring action because of the inductive load they carry) to disable both relays 32 and 33. This removes the enabling signal for the controller input 50 to effect shut down of the furnace.

The barometric damper 36 may be the commercially available model MG-1 Barometric Draft Control from Field Control Division-Conco Inc. of Mendota, Illinois. The damper 36 is installed on the vertically extending portion of the flue pipe just above the location of the draft switch 31. When either the draft goes more negative than the normal draft range, or the pressure rises above the normal draft range (0.03" $H_2O$), the damper plate 37 opens to neutralize the undesired pressure variation. The particular model mentioned opens in for negative pressures and out for positive pressures, but this is not essential.

Operation

When power is applied to the primary winding 57 of the input transformer 55, an energizing signal provided across the secondary winding 56 is applied to terminals 51 and 52 of the furnace controller 25. In the absence of a request for heat, contacts THS are open so that relays 32 and 33 are deenergized and the furnace controller 25 is disabled. Also, the stack damper plate 22 is closed, minimizing air flow through the vent stack 20 and conserving heat loss up the stack. When the damper 22 is closed, the draft switch 21 and barometric damper 37 are isolated from down drafts in the chimney. Contacts 41 are closed.

When contacts THS close in response to a request for heat, an AC signal is applied to conductor 60 and extended to the coil 45 of relay 32 and the warp switch heater 46 over a circuit path including contacts 41 of the draft switch 31 and normally closed contacts 34A of the warp switch. This initiates the pre-draft timing cycle and causes relay 32 to operate to close contacts 32A extending the signal on conductor 60 to conductor 58 and the furnace controller input 50, and to the energize winding 48 of the holding relay 33, which operates to close contacts 33A.

As described more fully in the referenced patent application, when an enabling signal is extended to the controller input 50, the stack damper control circuit 26 energizes the drive motor 23 to drive the stack damper plate 22 to the open position indicated by the dashed line in the drawing. When the damper plate 22 is driven fully open, the drive motor is deenergized, and the pilot valve 13 is energized under the control of the fuel supply circuit 28 to supply fuel to the pilot outlet 15 for ignition to provide a pilot flame. When a pilot flame is established, the fuel supply control circuit 28 energizes the main valve 14 to supply fuel to the main burner for ignition by the pilot flame.

As the damper plate 22 is driven to open the vent stack to the chimney and the fuel burns, the stack effect of the chimney provides a draft through the vent stack 20. Under normal conditions, a draft providing a negative gauge pressure of at least 0.03" $H_2O$ at the low pressure inlet 64 of the draft switch is established before the heating time of the bimetal warp switch 34, which is typically in the order of one to three minutes. The draft switch 31 responsively opens normally closed contacts 41. This interrupts the energizing path for relay coil 45 and the warp switch heater element 46. The relay 32 drops out, opening contacts 32A to terminate the pre-draft enabling cycle, and the heater element 46 begins to cool down, resetting the pre-draft timer cycle. The furnace controller 25 is maintained enabled via contacts 33A of the holding relay, and furnace operation continues uninterrupted as long as draft in the normal range is maintained and contacts THS remain closed.

If a draft (i.e. sub atmospheric) pressure at least 0.03" $H_2O$ is not established before the end of the timing interval defined by the warp switch, the warp switch 34 operates to open its contacts 34A. This interrupts the energizing path for relays 32 and 33 which drop out, removing the enabling signal from the controller input 50. Responsively, the fuel supply control circuit 28 deenergizes the fuel valves, extinguishing the flame, and the stack damper control circuit 26 reenergizes the drive motor 23 to rotate the stack damper plate 22 to the closed position. The system remains locked out until the warp switch timer 34 is manually reset.

For either excessive draft conditions, (below the normal draft range) or for a down draft during a heating cycle, (causing pressures above the normal draft range), the barometric damper 36 opens its damper plate 37 to communicate the vent with the atmosphere and thereby relieve excess stack pressure. The draft switch 31 responds to loss of draft during a normal heating operation to close contacts 41, thereby initiating a new pre-draft timing cycle. That is warp switch timer 34 begins a new timing cycle, with the furnace controller 25 being maintained operated during this new cycle. If the sufficient draft is not reestablished through the vent stack within the timing period of the warp switch, the draft switch 31 does not operate and warp switch contacts 34A open, deenergizing both relays 32 and 33, to disable the furnace controller 25.

When the heating demand has been met, contacts THS open, to disable relay 33 and remove the signal from the controller input 50. The fuel supply control circuit 28 deenergizes the fuel valves 12 to extinguish the flame. Also, the stack damper control circuit 26 energizes the drive motor 23 to drive the damper plate 22 to the closed position. As the damper plate is driven closed and the stack cools the draft switch 31 closes contacts 41 to prepare the system for the next heating cycle.

The control system of the present invention satisfies or circumvents the purposes of the draft hood heretofore used in gas-fired appliance installations. That is, the appliance is shut down under the control of the pre-draft enabling circuit 30 for sustained loss of draft, or stack down draft, which exists longer than the pre-draft time interval defined by the warp switch timer 34. The barometric damper 36 prevents excessive draft (negative pressure) or chimney down draft (pressure above the normal draft range) conditions from disturbing the fire.

The control arrangement includes inherent safety features. Burner operation can be interrupted only by the thermostat or the bimetal contacts 34A. For a failure of draft switch 31 with contacts 41 welded closed, then on the next call for heat, the warp switch timer is maintained energized even if draft is provided, and the system is locked out. If failure occurs in such a way that contacts 41 cannot close, relays 32 and 33 cannot operate, and the furnace controller 25 is maintained disabled. If the warp switch heater element 46 opens, then relay 32 cannot operate and the system cannot start. If the diaphragm 66 of the draft switch 31 ruptures, then the switch 31 maintains its contacts 41 closed and the system is locked out by the warp switch 34 on the next call for heat.

Having thus disclosed in detail a preferred embodiment of the invention, persons skilled in the art will be able to modify certain of the structure which has been illustrated and to substitute equivalent elements for those disclosed while continuing to practice the principle of the invention, and it is, therefore, intended that all such modifications and substitutions be covered as they are embraced within the spirit and scope of the appended claims.

I claim:

1. In a control system for an appliance having a burner, fuel valve means for connecting a source of fuel to said burner, a stack for coupling flue gasses from said appliance to a chimney, and a thermostat for generating a heat demand signal in response to a call for heat from a space to be heated, the improvement comprising: stack damper means operable between a closed and an open position; controller means responsive to an input signal for operating said stack damper means to said open position and for operating said fuel valve means to supply gas to said burner; pre-draft enabling circuit means responsive to said heat demand signal for generating a pre-draft enabling signal for a predetermined time interval and for coupling the same to an input of said controller means; sensing means in said stack for disabling said pre-draft enabling circuit means if a draft is sensed in said stack within said time interval; holding circuit means responsive to said heat demand signal for generating an input signal to said controller means after said pre-draft enabling circuit is disabled if draft is sensed within said time interval; and pressure responsive means for relieving pressure in said stack outside a predetermined normal range.

2. The system of claim 1 wherein said pre-draft enabling circuit includes first switch means responsive to a heat demand signal for generating an input signal to said controller means; and resettable timer circuit means for deactuating said first switching means after said time interval; said sensing means resetting said timer circuit means when draft is sensed within said time interval.

3. The system of claim 2 wherein said timer circuit means is further connected in circuit with said holding circuit means for disabling the same if draft is not sensed within said time interval.

4. The system of claim 3 wherein said sensing means energizes said timer circuit means when draft is lost for initiating another time interval within which draft must be detected or both said first switching means and said holding circuit means are de-actuated by said timer circuit means.

5. The system of claim 1 wherein said pressure responsive means senses draft in a predetermined normal range and communicates said stack with the ambient atmosphere if the pressure in said stack rises above said normal draft range.

6. The system of claim 5 wherein said pressure responsive means further communicates said stack with the ambient atmosphere if the pressure in said stack rises below said normal draft range.

7. The system of claim 5 wherein the high pressure defining said normal draft range is slightly below atmospheric pressure.

8. A system as set forth in claim 4 wherein said sensing means comprises a draft switch having normally closed contacts for coupling said heat demand signal to switch means of said pre-draft enabling circuit means, said switch maintaining said contacts closed in the absence of established draft, and said switch operating to open said contacts upon sensing said established draft.

9. A system as set forth in claim 8 wherein said first switching means of said pre-draft enabling circuit means responds to the heat demand signal extended over said contacts of said sensing means to generate said pre-draft enabling input signal for said controller means, said first switching means being disabled when said draft switch operates upon sensing said established air flow.

10. In control system for an appliance having a burner, fuel valve means for connecting a source of gas to said burner, and a stack for conducting flue gasses from said appliance to a chimney, the improvement comprising: pre-draft enabling means for enabling said fuel valve means tentatively for an interval of time at the start of an operating cycle to supply fuel to said burner apparatus, said pre-draft enabling means including timing means for defining said time interval; and sensing means responsive to draft in said stack for controlling said timing means to maintain said fuel valve means enabled after the end of said time interval and to permit said timing means to effect disabling of said fuel valve means in the absence of said perdetermined draft before the end of the time interval, and pressure responsive means in said stack for relieving pressure in said stack outside a normal draft range.

11. A system as set forth in claim 10 wherein said sensing means responds to pressure above said normal draft range during an operating cycle to cause said timing means to define a further time interval and to effect disabling of said fuel valve means in the event draft fails to be reestablished before the end of said further time interval.

12. A system as set forth in claim 10 further comprising stack damper means including a stack damper plate in said vent stack and operable between closed and open positions, and stack damper control means responsive to said pre-draft enabling means at the start of an operating cycle for operating said damper plate to said open position.

13. A system as set forth in claim 10 wherein said pressure responsive means comprises a barometric damper located within said vent stack, said damper normally closing a vent to a controlled space and being operable to open said vent the stack pressure is outside said normal draft range.

14. A system as set forth in claim 10 wherein said timing means is enabled over a first circuit path at the start of an operating cycle, said sensing means responding to predetermined draft in said normal range to interrupt said first circuit path to thereby disable said timing means, and said timing means being maintained enabled and operating to effect disabling of said fuel valve means whenever said sensing means fails to interrupt said first circuit path before the end of the time interval defined by said timing means.

15. A system as set forth in claim 14 wherein said enabling means includes switching means enabled over said first circuit path and operable to effect enabling of said fuel valve means, said switching means being disabled when said sensing operates to interrupt said first circuit path, and said fuel valve means being maintained enabled over a second circuit path including holding circuit means, said sensing means responding to a loss of draft during an operating cycle to complete said first circuit path thereby reenabling said switching means and said timing means.

16. A system as set forth in claim 15 wherein said timing means comprises a warp switch having a heating element connected in said first circuit path to be energized in response to a request for heat whenever said first circuit path is completed by said sensing means, said warp switch being operated when said heater element is heated for the duration of said time interval to interrupt said first circuit path and thereby disable said switching means.

17. A system as set forth in claim 16 wherein said warp switch further disables said holding circuit means when actuated thereby providing fail-safe operation of said draft sensing means.

18. A system as set forth in claim 15 wherein said sensing means comprises a differential pressure switch having normal closed contacts connected in said first circuit path, a first pressure inlet disposed within said stack, and a reference pressure inlet vented to ambient, said switch being operable to open said first contacts in response to a negative difference in pressures between its first and reference pressure inlets.

19. A method of controlling the operation of an appliance having a burner, fuel valve for connecting a source of fuel to said burner, a stack for coupling flue gasses from said appliance to a chimney, and a thermostat for generating a heat demand signal in response to a call for heat, comprising: tentatively establishing, for a predetermined time, a pre-draft enable signal; opening a damper in said stack and actuating said fuel valve means to supply fuel to said burner when said pre-draft enable signal is established; sensing a first pressure in said stack representative of draft; maintaining said stack damper opened and said fuel valve means actuated after said predetermined time only if draft is sensed within said time interval; and communicating said stack to the space surrounding said appliance to equalize the pressure in said stack when said pressure exceeds a preset value.

20. The method of claim 19 further comprising the step of communicating said stack to the space surrounding said appliance to equalize the pressure in said stack when said pressure falls below a normal draft range.

21. The method of claim 19 further comprising the step of re-initiating said pre-draft enable signal when draft is lost in said stack, and shutting off said controller if draft is not reestablished within a predetermined time.

* * * * *